US008201352B2

(12) United States Patent
Glenn

(10) Patent No.: US 8,201,352 B2
(45) Date of Patent: Jun. 19, 2012

(54) IRONING BOARD COVER WITH STORAGE POUCH

(75) Inventor: James L. Glenn, St. Albans, MO (US)

(73) Assignee: Household Essentials, LLC, St. Louis, MO (US)

( * ) Notice: Subject to any disclaimer, the term of this patent is extended or adjusted under 35 U.S.C. 154(b) by 251 days.

(21) Appl. No.: 12/626,336

(22) Filed: Nov. 25, 2009

(65) Prior Publication Data

US 2010/0126050 A1 May 27, 2010

Related U.S. Application Data

(60) Provisional application No. 61/117,883, filed on Nov. 25, 2008.

(51) Int. Cl.
*D06F 83/00* (2006.01)
*B65D 65/02* (2006.01)

(52) U.S. Cl. ..... 38/140; 150/158

(58) Field of Classification Search ..... 150/158, 150/165; 38/103, 104, 140, 141
See application file for complete search history.

(56) References Cited

U.S. PATENT DOCUMENTS

| | | | | |
|---|---|---|---|---|
| 2,241,309 | A * | 5/1941 | Kovalik | 38/141 |
| 2,884,722 | A | 5/1959 | Lehrman | |
| 3,007,267 | A * | 11/1961 | Goldsmith | 38/140 |
| 3,483,954 | A * | 12/1969 | Michalski | 206/223 |
| 4,085,873 | A | 4/1978 | Schweitzer | |
| 4,154,323 | A | 5/1979 | Sneider | |
| 4,621,003 | A | 11/1986 | O'Kane | |
| 5,161,319 | A | 11/1992 | Boyd | |
| 5,399,020 | A | 3/1995 | Cheng | |
| 5,743,417 | A | 4/1998 | Mathis | |
| 6,793,991 | B2 | 9/2004 | Thuma et al. | |
| 7,052,086 | B1 | 5/2006 | Treytiak | |
| 7,131,223 | B2 | 11/2006 | Krotts et al. | |
| D542,467 | S * | 5/2007 | Martin | D28/38 |
| 7,299,573 | B1 | 11/2007 | Kuncken | |
| 7,374,071 | B2 | 5/2008 | Lavelle | |
| 2003/0136034 | A1 | 7/2003 | Lehrman | |
| 2005/0076420 | A1 | 4/2005 | Hafif | |
| 2005/0144695 | A1 | 7/2005 | Aldridge et al. | |

* cited by examiner

*Primary Examiner* — Ismael Izaguirre
(74) *Attorney, Agent, or Firm* — Polster, Lieder, Woodruff & Lucchesi, L.C.

(57) ABSTRACT

An ironing board cover assembly has a cover sized and shaped to fit an ironing board. The cover folds into a compact arrangement for storage and unfolds into a expanded arrangement to secure to the ironing board. A pouch attached to the cover, receives the cover when the cover in the compact arrangement. When installed on the ironing board, the pouch receives ironing accessories.

20 Claims, 3 Drawing Sheets

IRONING BOARD COVER WITH STORAGE POUCH

CROSS-REFERENCE TO RELATED APPLICATIONS

This application is related to U.S. Provisional Patent Application No. 61/117,883 filed Nov. 25, 2008 from which priority is claimed, and is hereby incorporated by reference.

STATEMENT REGARDING FEDERALLY SPONSORED RESEARCH

Not Applicable.

BACKGROUND OF THE INVENTION

In the past, ironing board covers have been made from many different materials. During shipping and marketing ironing board covers are typically placed in packages, usually plastic, to protect the cover from damage.

However, the plastic storage packages add additional cost to the product. Further, they are typically discarded after purchase of the product. Disposal of these plastic packages is wasteful and potentially detrimental to the environment.

Therefore, there is a long felt need for a ironing board cover with an attachable pouch which protects the cover for shipping, packaging, and storing, and for methods of use.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
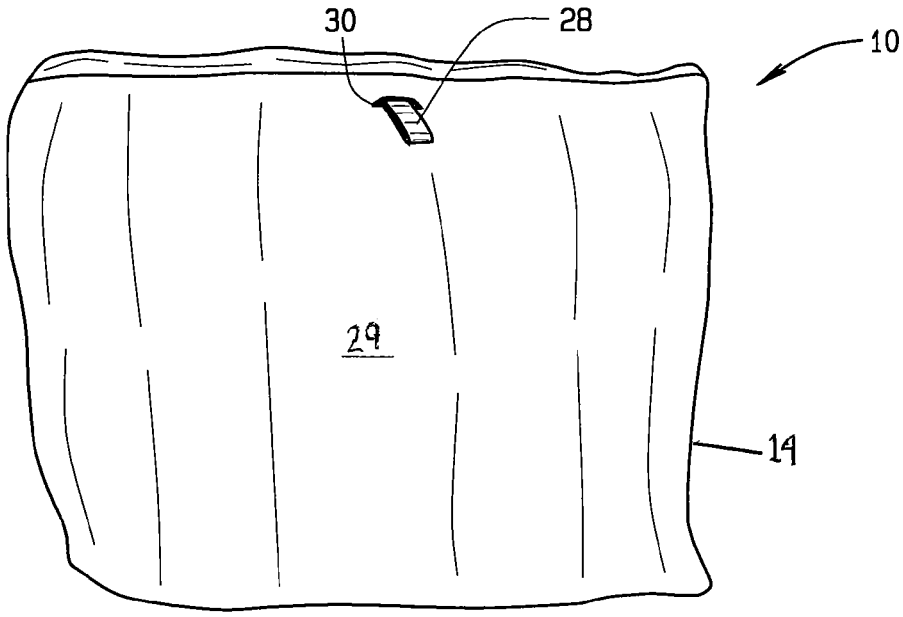
FIG. 1 is a side view of an embodiment of an ironing board cover assembly in accordance with and embodying the present invention.
Figure 2:
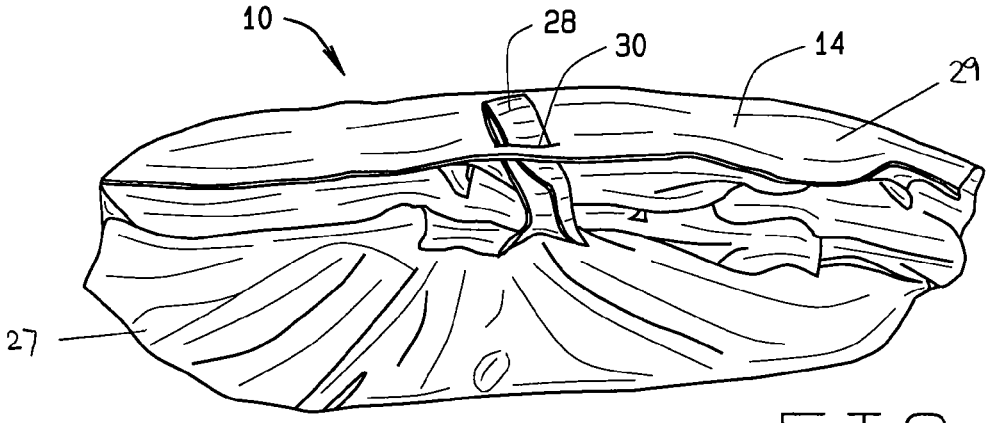
FIG. 2 is an end view of the ironing board cover assembly with a tab engaged with a slot.
Figure 3:
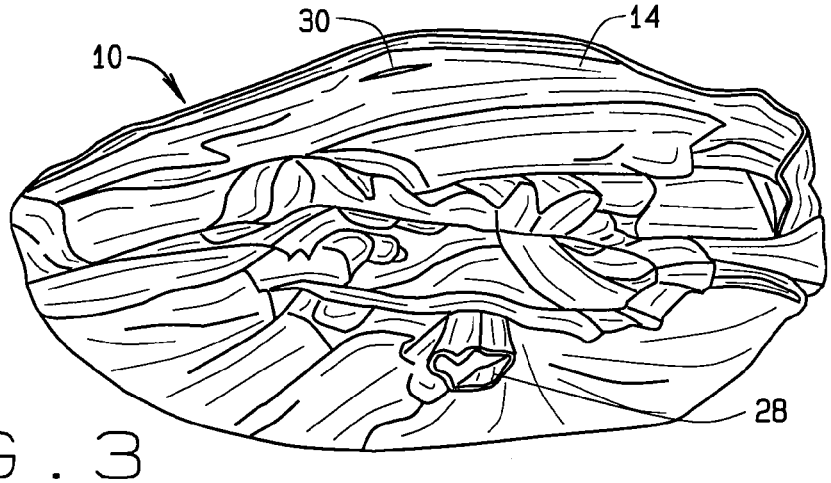
FIG. 3 is an end view of the ironing board cover assembly with the tab removed from the slot.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 4:
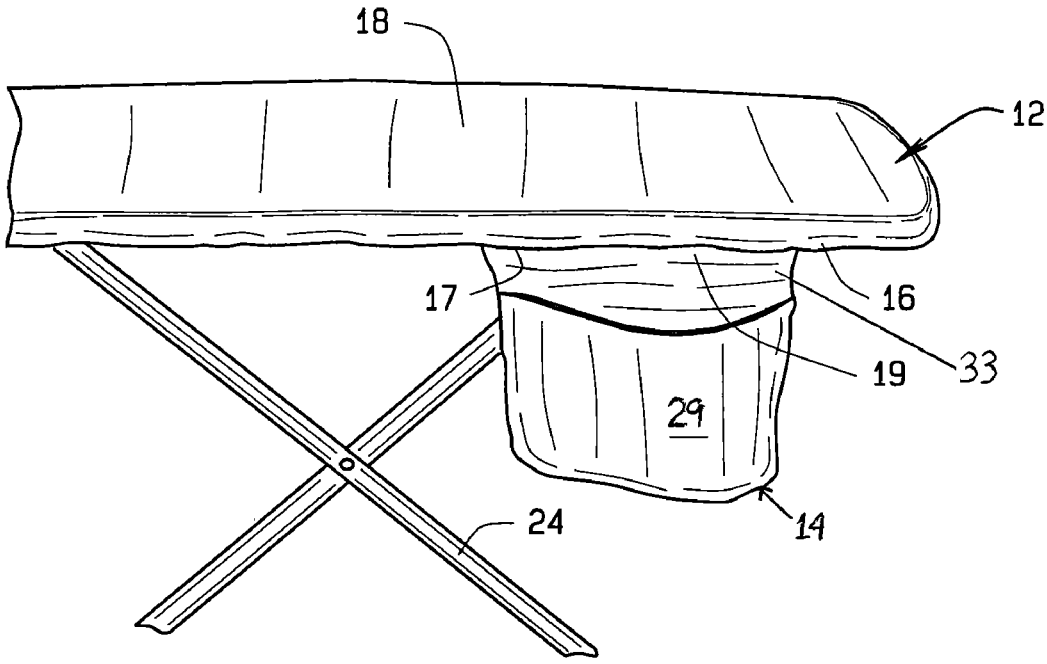
FIG. 4 is a isometric view of the ironing board cover assembly engaged with an ironing board with the pouch in an accessible position.
Figure 5:
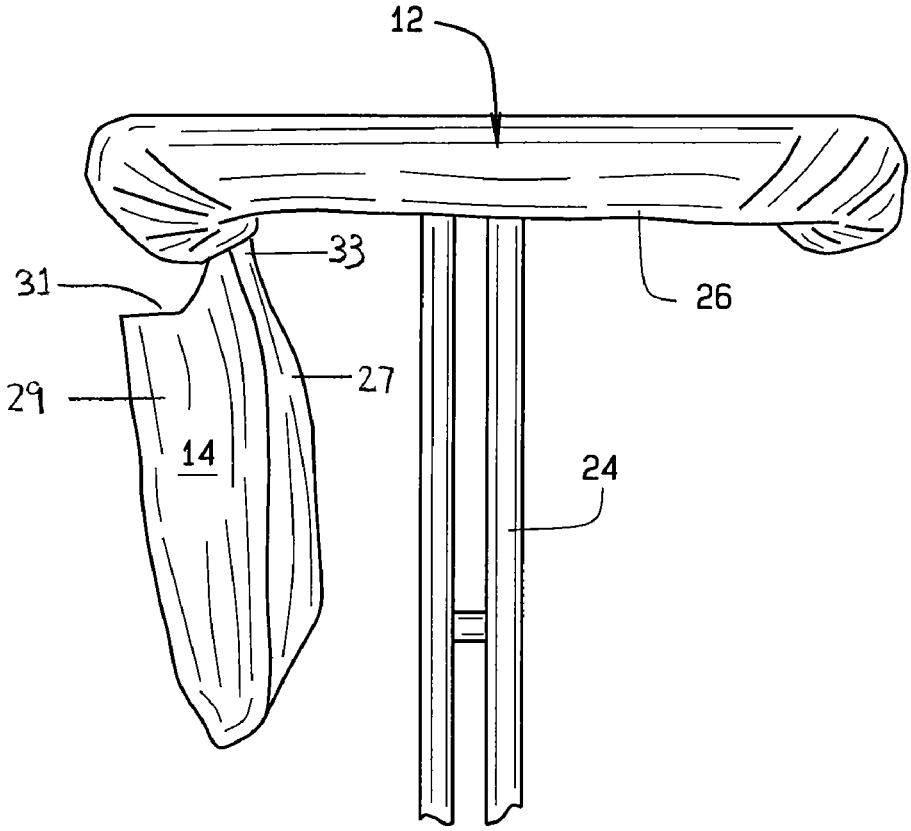
FIG. 5 is an end view of the ironing board cover assembly engaged with the ironing board with the pouch in the accessible position.

As shown in FIGS. 1-7, an embodiment of the present invention, generally referred to as an ironing board cover assembly 10, includes an ironing board cover 12 having a pouch 14 attached to a side portion 16 of the cover 12. The pouch 14 is attached preferably to the side portion 16 by a thread 17 stitched along an upper edge 19 of the pouch 14. (FIGS. 4-5). The upper edge 19 effectively defines an axis for the cover 12 to pivot about between a storage position where the cover 12 is folded, rolled up, or otherwise compressed or made more compact for storage within the pouch (FIG. 1), and an ironing position, where the cover 12 is removed from the pouch 14 and expanded for installment on an ironing board (FIG. 4).

The cover 12 is sized and shaped to fit over an ironing board 18. The ironing board 18 is embodied as a typical ironing board with a generally rectangular rear portion 20 and a narrowing nose portion 22, which is supported by collapsible legs 24. However, those skilled in the art will recognize that any size or shape of ironing board can be used. The cover 12 also includes a binding 26, including, but not limited to a bungee cord, elastic, or drawstring, positioned around the perimeter of the cover 12 for securing the cover 12 to the ironing board 18. When the cover 12 is installed on the ironing board 18, the binding 26 contracts on the underside of the ironing board 18 to secure the cover 12.

The cover 12 and pouch 14 can be made of cotton as known in the art, or can be made from a material with burn/scorch resistant characteristics, such as disclosed in U.S. Pat. No. 5,566,481. In other embodiments, the cover 12 includes multiple layers of materials, including but not limited to a layer of foam padding.

The pouch 14 includes a generally rectangular first panel 27 and a generally rectangular second panel 29. The first and second panels 27 and 29 are attached, such as by stitching, along three edges, thereby forming an opening 31 sized and shaped for receiving ironing accessories during use and for receiving the cover 12 during storage. The first panel 27 has an extended portion 33 that extends beyond the second panel 29 for attachment to the side portion 16 of the cover 12. The extended portion 33 positions the opening 31 at a predetermined distance below the cover 12 to provide easier access to the opening 31. In addition, the extended portion 33 provides greater flexibility so that the cover 12 can insert deeper into the pouch 14 as the cover pivots into the storage position.

A tab 28 attaches to the side portion 16 of the cover 12 and in a position adjacent to the pouch 14 and at about a midpoint of the upper edge 19 of the extended portion 33. The second panel 29 defines a slot 30 positioned at about a midpoint of an upper edge of the second panel 29. In this position, the slot 30 is sized and shaped to receive the tab 28 when the cover 12 is folded into the compact arrangement and placed within the pouch 14 in the storage position. When the cover 12 is folded into the compact arrangement and placed within the pouch 14, the tab 28 on the cover 12 can insert through the slot 30 on the second panel 29 to secure the cover 12 within the pouch 14. In this way, the pouch 14 serves as an outer protective package for the cover 12. Therefore, no additional protective packaging is necessary for transport and display in a retail setting. Also, the tab 28 can be engaged by the user for transport or hanging.

Figure 6:
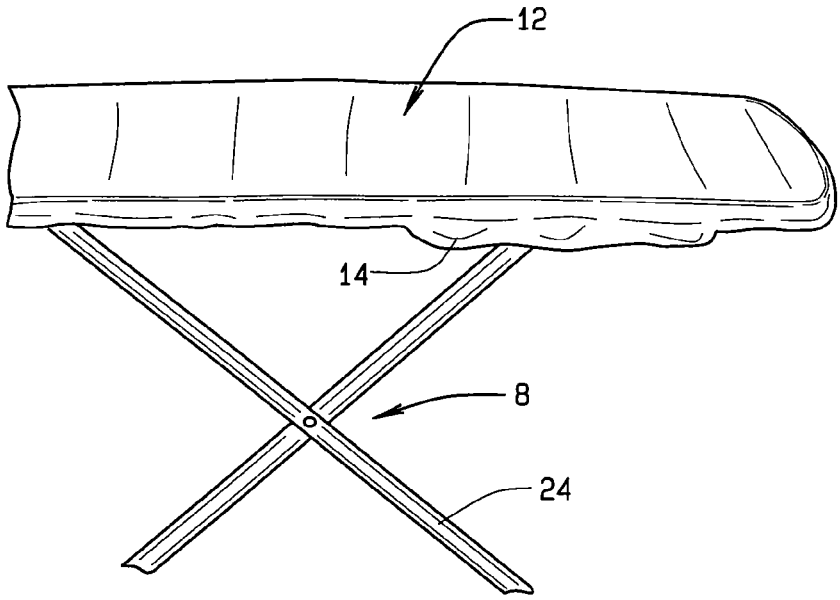
FIG. 6 is a isometric view of the ironing board cover assembly engaged with the ironing board with the pouch in the inaccessible position.
Figure 7:
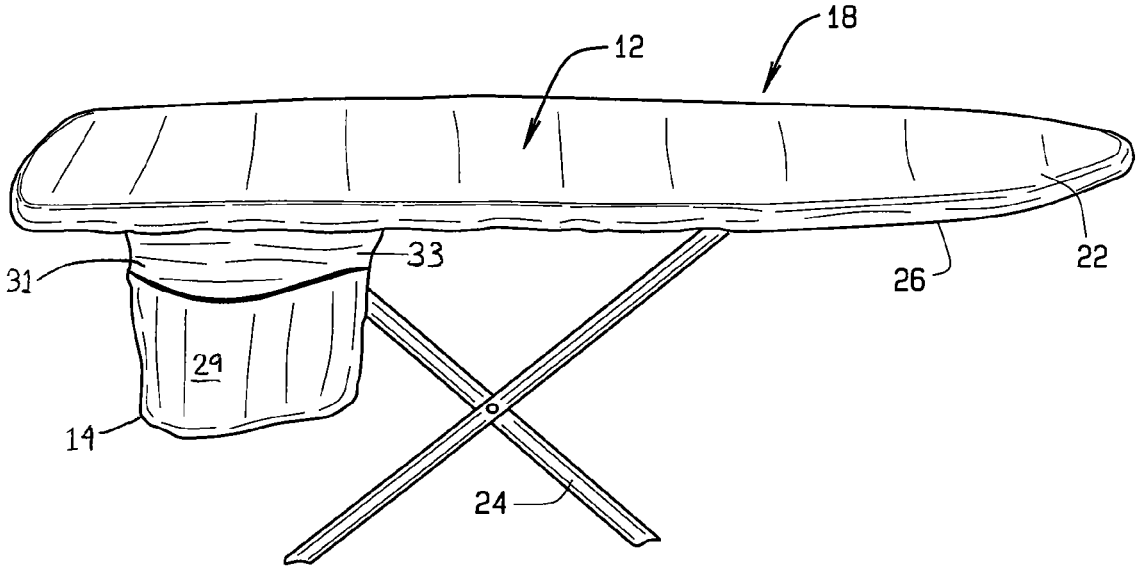
FIG. 7 is a isometric view of the ironing board cover assembly engaged with the ironing board in a reversed position with the pouch in the accessible position.

When the cover 12 is removed from the pouch 14, the cover 12 can be unfolded into the expanded arrangement and placed over the ironing board 18, with the binding 26 securing the cover 12 underneath the ironing board 18. (FIGS. 4-5). For use, the pouch 14 hangs downwardly from the side portion 16 of the cover 12 in an accessible position to receive and support ironing accessories, such as a container of starch or spray bottle. If use of the pouch 14 is not desired, the pouch 14 can be placed underneath the cover 12 in an inaccessible position, in between the ironing board 18 and the cover 12. (FIG. 6). If desired, the user may also reverse the cover 12 and pouch 14 before placing it on the ironing board 18. (FIG. 7). In this position, the pouch 14 is located on the opposite side of the ironing board 18. The operator can then turn on the iron 36 and begin ironing clothes on the board 18 and cover 12.

Those skilled in the art will recognize that other appropriate means of securing the pouch 14 can be used, including but not limited to adhesive or removable fasteners, such as snaps or Velcro® brand fabric hook and loop fastener materials. While the present embodiment shows a generally rectangular shaped pouch 14 secured to the side portion of the cover 12, other shapes, including but not limited to circular, trapezoidal, triangular, or oblong can be provided. Further, other sizes and locations can be used.

Changes can be made in the above constructions without departing from the scope of the invention, it is intended that all matter contained in the above description or shown in the accompanying drawings shall be interpreted as illustrative and not in a limiting sense. For example, in an alternate embodiment, the pouch is removable from the cover, such as with snaps, Velcro®, or other fastening device.

What is claimed is:

1. An ironing board cover assembly, comprising:

a cover sized and shaped to fit an ironing board, the cover being shaped and sized for folding into a compact arrangement and unfolded into an expanded arrangement; and a pouch attachable to the cover, the pouch defining an opening sized and shaped to receive the cover when the cover is in the compact arrangement, the opening being shaped and sized to receive ironing accessories when the cover is in the expanded arrangement.

2. The ironing board cover assembly of claim 1, wherein the composition of the pouch and shape and size of the pouch protects the cover during transport and during display in a retail setting.

3. The ironing board cover assembly of claim 1, wherein the cover and the pouch are reversible.

4. The ironing board cover assembly of claim 1, further comprising, a binding positioned around at least a portion of the perimeter of the cover and shaped and sized to detachably secure the cover to the ironing board.

5. The ironing board cover assembly of claim 1, wherein the pouch is assembled with the cover to allow for positioning of the pouch in an accessible position hanging downwardly from the cover and in an inaccessible position between the cover an the ironing board.

6. A cover assembly for an ironing board, comprising:

a cover sized and shaped to fit the ironing board and for conversion between a compact arrangement and an expanded arrangement;

a pouch attached to the cover along an axis, the pouch defining an opening sized and shaped to receive the cover when the cover is in the compact arrangement; and wherein the cover is shaped and sized to pivot about the axis between a storage position with the cover in the compact arrangement and positioned within the pouch, and an ironing position with the cover in the expanded arrangement and positioned outside of the pouch for installment on an ironing board;

a tab positioned on the cover generally adjacent to the pouch; and the pouch having a first panel attached to the cover along the axis and a second panel attached to the first panel, the second panel defining a slot sized and shaped for receiving the tab for securement of the cover within the pouch when the cover is in the compact arrangement.

7. The cover assembly for an ironing board of claim 6, wherein the pouch is sized and shaped to receive ironing accessories when the cover is in the expanded arrangement.

8. The cover assembly for an ironing board of claim 6, wherein the composition of the pouch and shape and size of the pouch protects the cover during transport and during display in a retail setting.

9. The cover assembly for an ironing board of claim 6, wherein the cover, and the pouch are reversible.

10. The ironing board cover assembly of claim 6, wherein the pouch is assembled with the cover to allow for positioning in an accessible position hanging downwardly from the cover and in an inaccessible position between the cover an the ironing board.

11. The ironing board cover assembly of claim 6, further comprising, a binding positioned around at least a portion of the perimeter of the cover and shaped and sized to detachably secure the cover to the ironing board.

12. A self-storing cover assembly for an ironing board:

a cover sized and shaped to fit an ironing board;

a pouch attachable to the cover, the pouch defining an opening sized and shaped to receive the cover;

wherein the cover is shaped and sized to pivot about the axis between a storage position with the cover positioned within the pouch, and an ironing position with the cover positioned outside of the pouch for installment on an ironing board;

a tab positioned on the cover substantially adjacent to the pouch; and the pouch having a first panel attached to the cover along the axis and a second panel attached to the first panel, the second panel defining a slot sized and shaped for receiving the tab for securement of the cover within the pouch.

13. The self-storing cover assembly of claim 12, wherein the pouch is sized and shaped to received ironing accessories when the cover is positioned in the ironing position.

14. The self-storing cover assembly of claim 12, wherein the composition of the pouch and shape and size of the pouch protects the cover during transport and during display in a retail setting.

15. The self-storing cover assembly of claim 12, wherein the cover and the pouch are reversible.

16. The ironing board cover assembly of claim 12, further comprising, a binding positioned around at least a portion of the perimeter of the cover and shaped and sized to detachably secure the cover to the ironing board.

17. The self-storing cover assembly of claim 12, wherein the pouch is assembled with cover to allow positioning of the pouch in an accessible position hanging downwardly from the cover and in an inaccessible position between the cover and the ironing board.

18. A method of self-storing an ironing board cover assembly, comprising the steps of:

providing a cover sized and shaped to fit an ironing board, the cover being shaped and sized for folding into a compact arrangement and unfolded into an expanded arrangement;

providing a pouch attachable to the cover, the pouch defining an opening sized and shaped to receive the cover when the cover is in the compact arrangement, the opening being shaped and sized to receive ironing accessories when the cover is in the expanded arrangement;

folding the cover into the compact arrangement;

placing the cover into the pouch;

removing the cover from the pouch; and attaching the pouch to the cover.

19. The method of claim 18, further comprising the steps of:

providing a tab positioned on the cover generally adjacent to the pouch;

providing a slot in the pouch that is configured to receive and frictionally engage the tab; and further comprising the following steps occurring after the step of placing the cover in the pouch;

inserting the tab through the slot in the pouch; and removing the tab from the slot in the pouch.

20. An ironing board cover assembly, comprising:

a cover sized and shaped to fit an ironing board, the cover being shaped and sized for folding into a compact arrangement and unfolded into an expanded arrangement; and a pouch attachable to the cover, the pouch defining an opening sized and shaped to receive the cover when the cover is in the compact arrangement, the opening being shaped and sized to receive ironing accessories when the cover is in the expanded arrangement;

a tab positioned on the cover generally adjacent to the pouch; and the pouch having a first panel attached to the cover and a second panel attached to the first panel, the second panel defining a slot sized and shaped for receiving the tab.

* * * * *